US005161600A

United States Patent [19]

Brodersen et al.

[11] Patent Number: 5,161,600

[45] Date of Patent: Nov. 10, 1992

[54] SYSTEM AND METHOD FOR CASTING AND REWORKING METALLIC MATERIAL

[75] Inventors: Craig Brodersen, Wallingford; Arun Prasad, Cheshire, both of Conn.

[73] Assignee: Jeneric/Pentron Inc., Wallingford, Conn.

[21] Appl. No.: 614,713

[22] Filed: Nov. 16, 1990

[51] Int. Cl.[5] ..... B22D 13/06

[52] U.S. Cl. ..... 164/289; 164/286

[58] Field of Search ..... 164/289, 290, 286, 154; 228/45

[56] References Cited

U.S. PATENT DOCUMENTS

| | | | |
|---|---|---|---|
| 2,011,955 | 8/1935 | Touceda | 164/289 |
| 2,806,271 | 9/1957 | Operhall | 22/200 |
| 3,435,878 | 1/1969 | Howard et al. | 164/51 |
| 3,814,259 | 6/1974 | Kamimura et al. | 210/391 |
| 4,254,817 | 3/1981 | Kidowaki et al. | 164/252 |
| 4,280,551 | 7/1981 | Ohara | 164/287 |
| 4,492,572 | 1/1985 | Linn | 432/263 |
| 4,568,809 | 2/1986 | Linn | 219/10.41 |
| 4,627,482 | 12/1986 | Waterstrat | 164/514 |
| 4,654,858 | 3/1987 | Rowe | 373/72 |
| 4,700,769 | 10/1987 | Ohara et al. | 164/514 |
| 4,709,741 | 12/1987 | Nakamura | 164/35 |
| 4,768,757 | 9/1988 | Nakamura et al. | 266/252 |
| 4,830,083 | 5/1990 | Nakamura | 164/35 |
| 4,830,823 | 5/1989 | Nakamura | 420/420 |
| 4,919,191 | 4/1990 | Brodersen | 164/495 |

FOREIGN PATENT DOCUMENTS

| | | | |
|---|---|---|---|
| 2358225 | 3/1978 | France | 164/289 |
| 1349936 | 11/1987 | U.S.S.R. | 228/45 |
| 866275 | 4/1961 | United Kingdom | 164/289 |

OTHER PUBLICATIONS

"A Novel Method for Vacuum Casting Titanium" by Hruska, The International Journal of Prosthodontics, vol. 3, No. 2, pp. 142–145.

Advertisement, Castmatic-S Automatic Caster discloses use of Argon gas, Invateni International Cooperation.

Advertisement, CYCLARC.

Advertisement, OHARRA Pure Titanium Casting System by Kitamara, Ohara Co. Ltd.

*Primary Examiner*—Kuang Y. Lin

*Attorney, Agent, or Firm*—Perman & Green

[57] ABSTRACT

The system comprises a main casting unit and a glove box unit for reworking cast items. The main casting unit has a frame with a casting chamber, a heating element, a vacuum, a supply of inert gas and a rotatable casting arm for spin casting molten material into a mold. The arm is adapted to removably mount a crucible and mold at one end and, an adjustable counterweight at the other end. The heating element can be moved into and out of the path of the arm and is adapted to heat metallic material in the crucible. The main casting unit also has a driver that projects into the chamber for driving the casting arm with reduced wear on seals between the chamber wall and the driver. A safety bar is provided to prevent the arm from spinning except when desired. The main unit also has electrical and gas conduit connectors for connecting the glove box unit to the main unit.

18 Claims, 8 Drawing Sheets

SYSTEM AND METHOD FOR CASTING AND REWORKING METALLIC MATERIAL

BACKGROUND OF THE INVENTION

1. Field of the Invention

The present invention relates to casting molten metal and, more particularly, to an apparatus, system and method for forming and reworking metallic casts.

2. Prior Art

Titanium and like metals present a great challenge to efficient manipulation and forming, since they can be heated only with special precautions to prevent contamination of the metal from the environment. This is particularly true in making medical and dental castings, and even in forming ingots, because these metals can be safely melted only in inert or highly rarefied atmospheres.

Prior art in the field of forming molten metal, and particularly forming molten titanium and the like, may be very roughly divided into tilt-to-pour, bottom-pour, and countergravity systems. Each has its own drawbacks. Another type of method of forming or casting molten metal is known as spin or centrifugal casting. Ohara Company, Ltd. of Osaka, Japan manufactures and sells a casting machine called "Titaniumer" that spins a mold to allow molten metal from a ceramic crucible to flow thereinto. U.S. Pat. No. 4,700,769 to Ohara et al. and U.S. Pat. No. 4,280,551 to Ohara also disclose casting apparatus for titanium and titanium alloys.

Use of titanium and its alloys as medical and dental implants is well recognized Such recognition has been attained due to their excellent corrosion resistance and biocompatibility in the body environment. The ability to passivate (to form an invisible and tightly adherent inert oxide film which is quickly reestablished whenever it is subjected to abrasion) instantaneously in air at room temperature imparts these excellent chemical and biological qualities to pure titanium and its alloys. Their corrosion resistance is comparable to or exceeding that of cobalt chrome alloys or stainless steel.

Low specific gravity and excellent mechanical properties of titanium and its alloys also make them ideal restorative materials for dentistry. The weight of titanium, per unit volume, is half that of Ni and Co-Cr alloys and one quarter that of the gold alloys. Therefore, for a given volume of the prosthesis, only one half and one-quarter of the weight of titanium is required. Low thermal conductivity of these materials would also impart no or significantly less hot or cold feelings to the surrounding tissue upon intake of hot and cold fluids. The difficulty of casting titanium and its alloys arise from the fact that they are very high melting, such as greater than 1,700° C., and their strong affinity for oxygen, nitrogen, hydrogen and carbon in the molten condition. Attempts to circumvent these problems have focussed on the casting environment, specific gravity consideration and the mold materials. To force the molten metal into the intricate mold cavities two methods have been used. A first method does not use a vacuum, but rather, uses argon gas saturation in combination with centrifugal force. However, this first type of method does not provide for the removal of all reactive gases or elements, such as oxygen, nitrogen, hydrogen, etc. Thus, these reactive elements contaminate the titanium during its cast. In addition, the ceramic crucible used for melting is another source of contamination. A second method uses pressure differential force, argon saturation, and mediocre vacuum. However, this second type of method does not provide for the fast casting of molten material into a mold. This method also tends to aspirate the metal thereby creating forthing. Because of the fact that titanium and its alloys have very high melting points (greater than 1,700° C.) and low density, if not cast into the mold very fast, portions of the molten material can cool and solidify before the mold is completely filled, thus resulting in an improper cast. Attempts to improve the castability by using hot molds in the past, only further contaminated the metals and alloys.

SUMMARY OF THE INVENTION

The foregoing problems are overcome and other advantages are provided by a new and improved apparatus, system and method for forming and reworking metallic casts.

In accordance with one embodiment of the present invention, an apparatus for casting metallic material is provided having a frame with a chamber, a heating source, means for evacuating the chamber, and means for spin casting the molten metallic material in the chamber. The means for spin casting comprises a rotatable arm, a crucible and mold assembly, and means for removably mounting the crucible and mold assembly with the arm.

In accordance with another embodiment of the present invention, an apparatus for casting metallic material is provided having a frame with a chamber, a heating source, and means for spin casting the metallic material comprising a rotatable arm connected to a drive shaft and a mold on the arm. The means for spin casting further comprises a driver for axially rotating the drive shaft, means for selectively engaging and disengaging the driver with the drive shaft, means for biasing the drive shaft at a first position, and means for preventing axial rotation of the drive shaft past a predetermined angular rotation.

In accordance with another embodiment of the present invention, an apparatus for casting metallic material is provided having a frame with a chamber, a heating source, and means for spin casting the metallic material into a mold including a rotatable arm. The apparatus further comprises a safety bar movably mounted to the frame and at least partially movable in the chamber. Means are provided for selectively moving the safety bar into and out of the path of the rotatable arm in the chamber.

In accordance with another embodiment of the present invention, a system for casting and reworking metallic material is provided. The system has a glove box unit, a main unit, and means for connecting the glove box unit with the main unit. The glove box unit has an electrode. The main unit has a chamber with a heating source, means for spin casting metallic material into a mold, and a system control.

In accordance with one method of the present invention, a method of casting metallic material is provided comprising steps of positioning the metallic material in a non-contaminating crucible, the crucible being located in a vacuum chamber; evacuating air from the vacuum chamber; introducing an inert gas into the vacuum chamber; evacuating the inert gas and residual air from the vacuum chamber if desired; introducing enough inert gas into the vacuum chamber to allow creation of an arc; heating the metallic material in the crucible into a molten state; and casting the molten material into a mold.

In accordance with another embodiment of the present invention, a method of casting metallic material into a mold comprises steps of positioning metallic material in a crucible, the crucible being located on a spin arm inside a vacuum chamber of a casting apparatus, the arm being rotatable in a first plane; positioning an electrode into the first plane over the metallic material and arc melting the metallic material; moving the electrode away from the crucible in a plane transverse to the first plane; and spinning the arm, crucible and metallic material in the first plane to allow the metallic material to flow into the mold.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
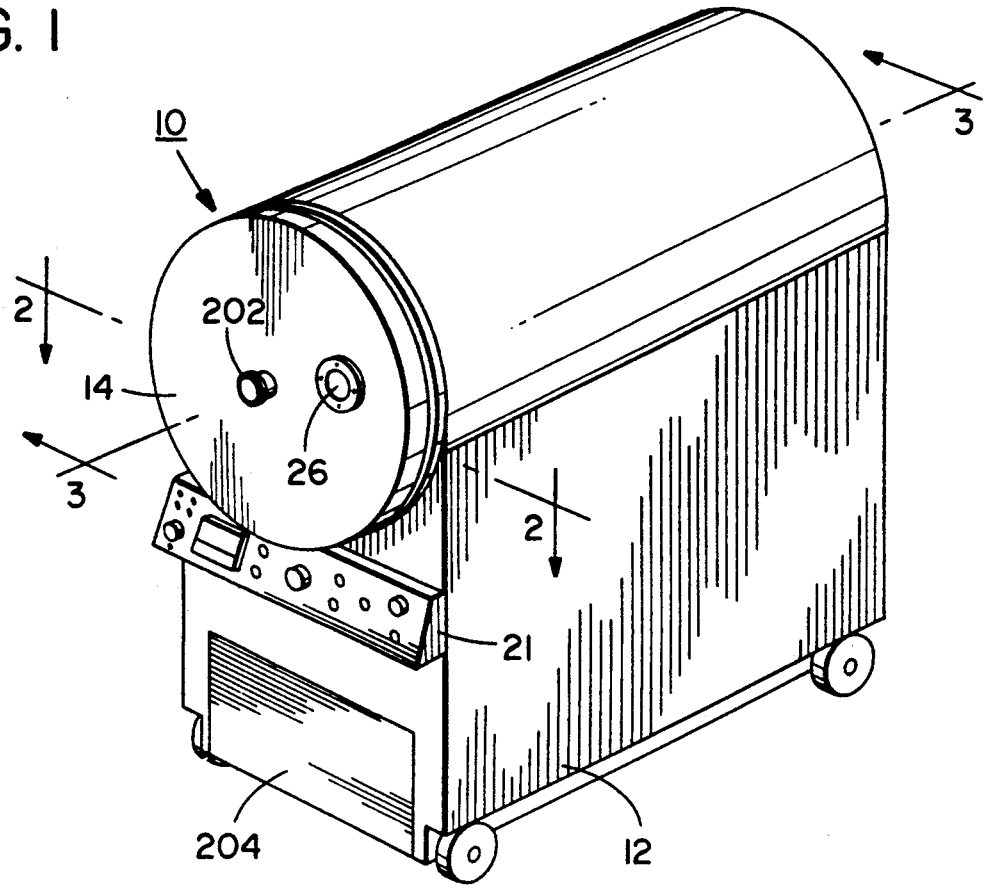
FIG. 1 is a perspective view of a centrifugal casting furnace incorporating features of the present invention.
Figure 2:
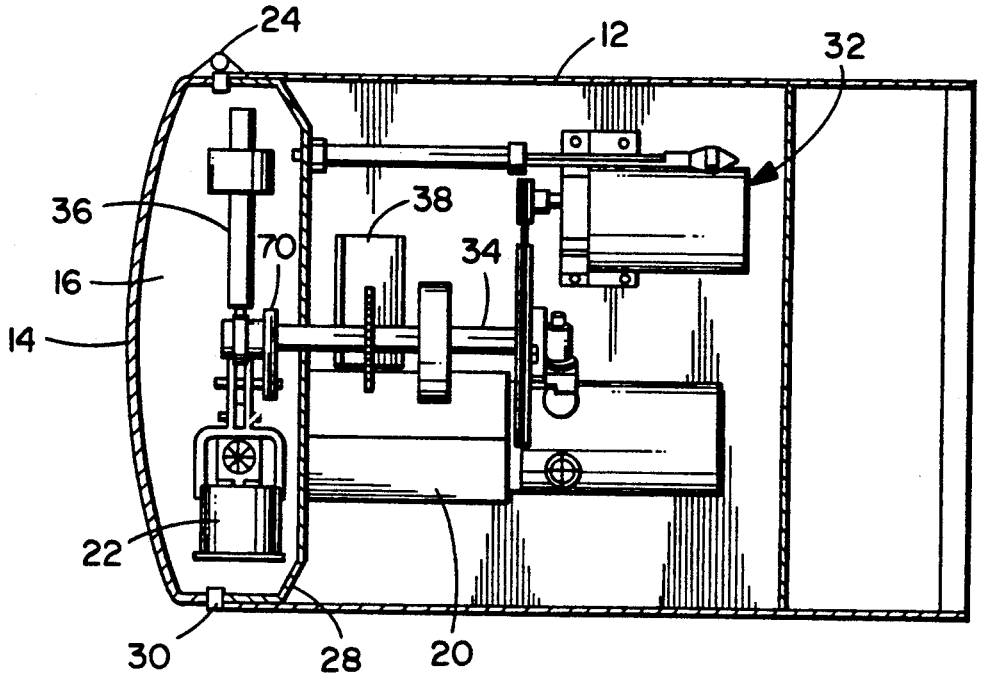
FIG. 2 is a schematic cross sectional view of the furnace shown in FIG. 1 taken along line 2—2.
Figure 3:
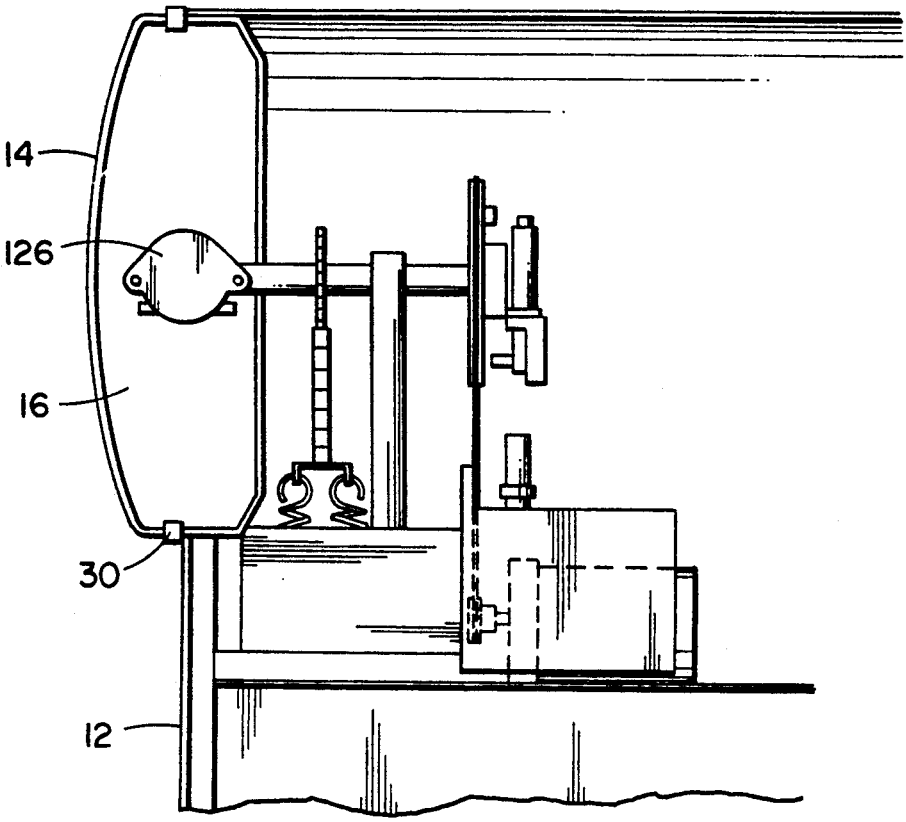
FIG. 3 is a partial schematic cross sectional view of the furnace shown in FIG. 1 taken along line 3—3.

Referring now to FIG. 1, there is shown a perspective view of a centrifugal casting furnace 10 incorporating features of the present invention. It should be understood that the following description, with the aid of the embodiment shown in the drawings, is only illustrative. Additional or less features can be provided in alternate embodiments. In addition, any suitable size, shape or type of elements or materials can be used.

The furnace 10 shown in FIG. 1 is generally intended for use in casting dental castings. However, it can be used in any suitable type of casting application. Referring also to FIGS. 2, 3, 4 and 5, in the embodiment shown, the furnace 10 generally comprises a frame 12 with a front door 14 forming a working chamber 16, a heating mechanism 18, an evacuating pump 20, a system controller 21, and means for spin casting metallic material into a mold 22. The door 14 is pivotally mounted on the frame 12 at hinge or pivot 24 and is provided with suitable locking means (not shown) to keep the door 14 in a closed and locked position during select steps in the casting process. The door 14 also comprises a view port 26 made of glass that can withstand high temperatures. The working chamber 16 is generally formed by the door 14 and an interior chamber wall 28. A suitable seal 30 is provided at the front face of the interior chamber wall 28 to meet with the door 14 when closed and seal the chamber 16 at the door 14. Alternatively, the seal 30 can be provided on the door 14. In the embodiment shown, the chamber 16 is relatively disk shaped. As seen best in FIG. 5, the rear of the interior chamber wall has five apertures; a first aperture 54 for passage of the drive shaft 34 therethrough, a second aperture 56 for passage of the safety bar 152 therethrough, a third aperture 58 for the introduction of gas into the chamber 16, a fourth aperture 60 for evacuating gas and air from the chamber 16, and a fifth aperture 62 for passage of a portion of the heating mechanism 18 therethrough. However, any suitable number of apertures could be provided including more or less than five.

Figure 4:
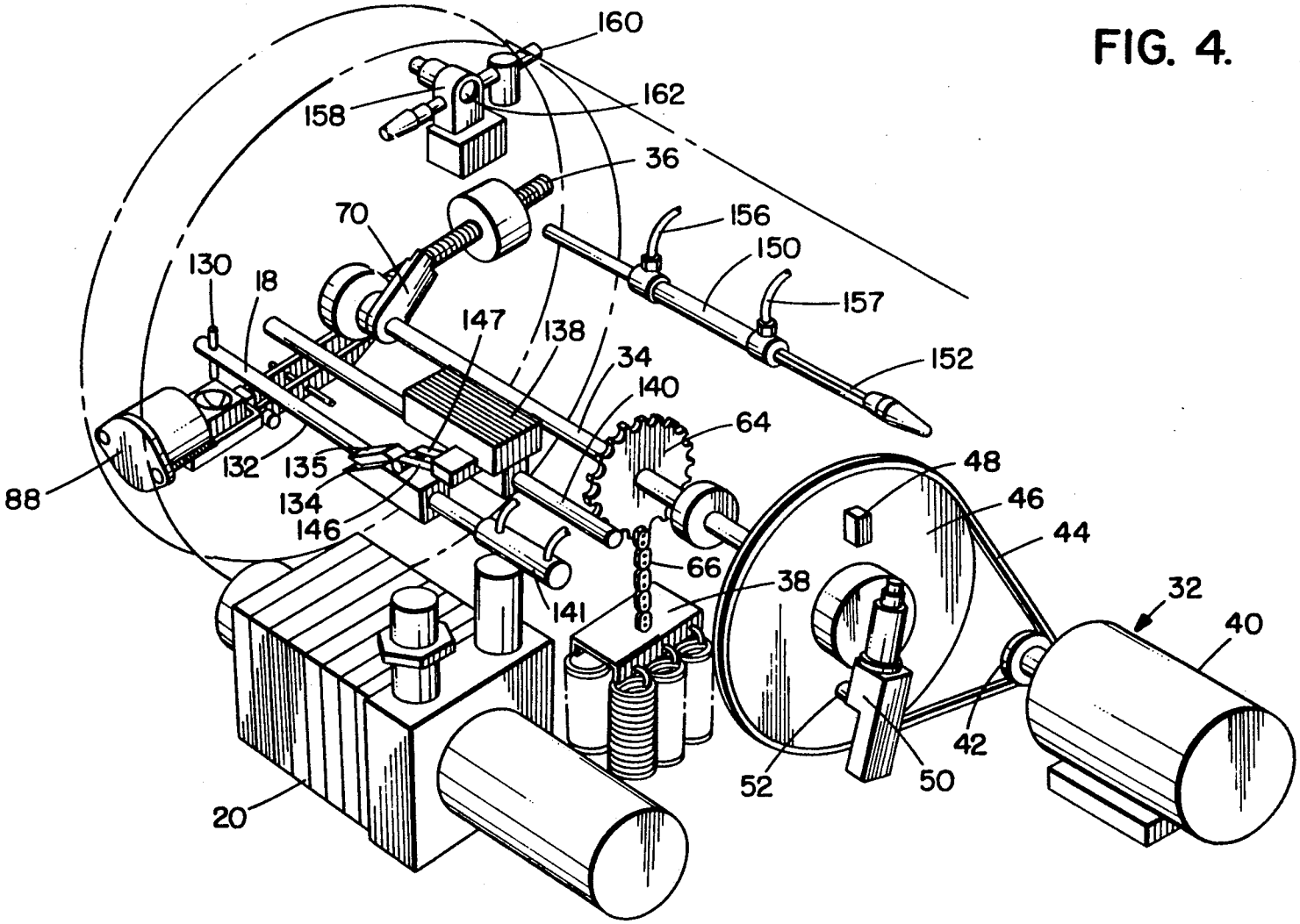
FIG. 4 is a schematic perspective view of some of the internal mechanisms in the furnace shown in FIG. 1.
Figure 5:
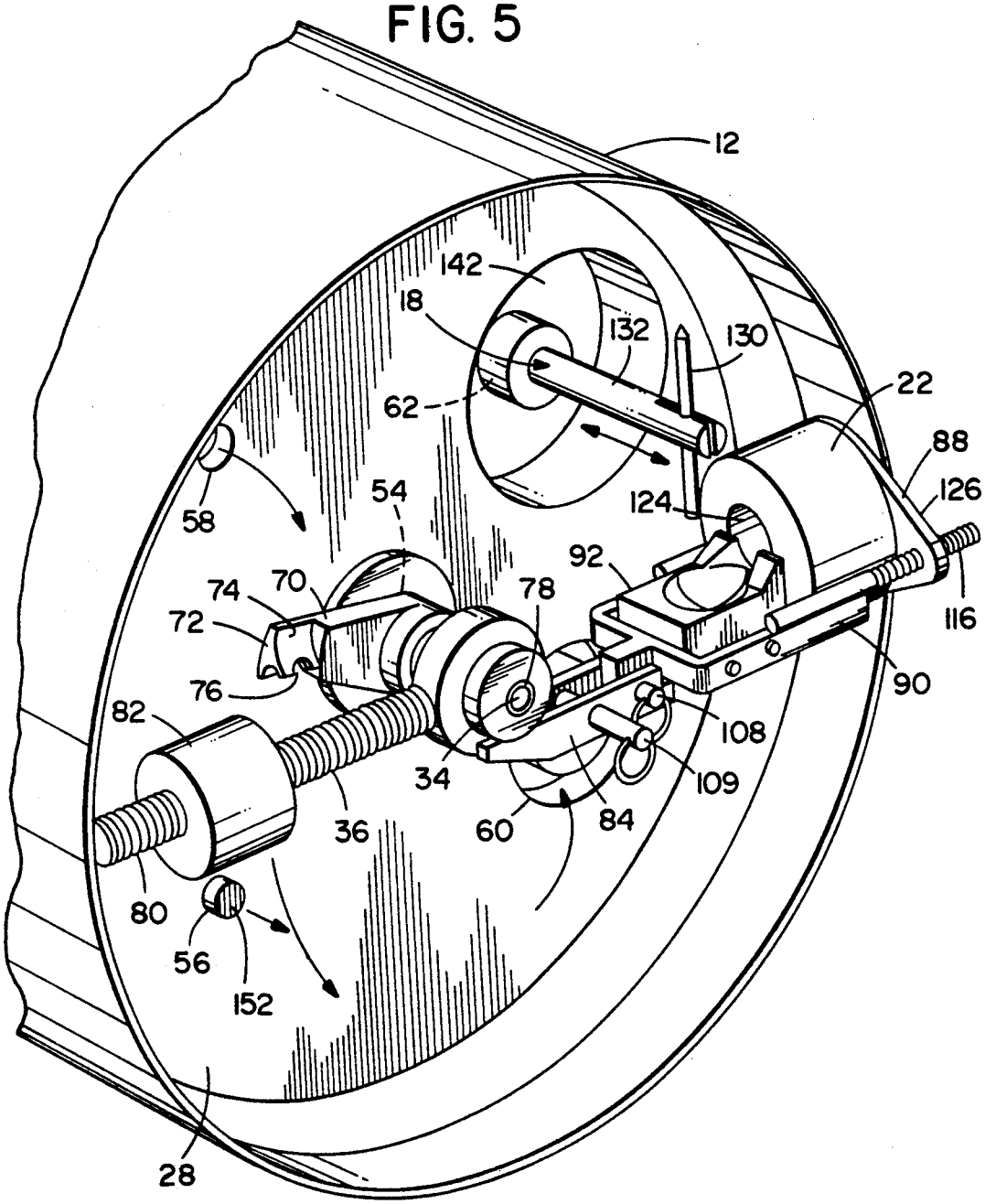
FIG. 5 is a front perspective view of the working chamber of the furnace shown in FIG. 1.

The working chamber 16, in the embodiment shown, is generally intended to provide a sealable or controllable environment to evacuate potential contaminants, such as oxygen, hydrogen, etc., allow the establishment of an inert or nonreactive atmosphere, such as helium, argon, etc , protect workers from heat generated during the melting process, and protect workers for inadvertent harm from moving parts in the chamber 16. The door 14 allows an operator access to the chamber to position ingots of metal in the crucible and remove a mold after the metal is cast. The fourth aperture 60 is connected to the evacuating pump 20. When the evacuating pump 20 is activated and the door 14 is closed, it can suck gases out of the chamber 16 to create a vacuum in the chamber 16. Suitable means are provided with the evacuating pump 20 such that when the pump is deactivated, air or gases will not rush back into the chamber 16 through the fourth aperture 60. The seal 30 and other seals at the first, second, and fifth apertures 54, 56 and 62 prevent air from entering the vacuum chamber 16 via these apertures. As best seen in FIG. 4, a gas valve 158 is connected to the third aperture 58 which is connected to a gas supply conduit 160. The valve 158 is a three way valve with an aperture 162 to the atmosphere. The gas supply conduit 160 can be connected to a source of inert gas (not shown) such as helium or argon. The valve 158 is an electrically controlled valve that has three positions; a first position that is closed, a second position that allows inert gas to flow from conduit 160 into the chamber 16, and a third position that allows air to flow into the chamber 16. The valve 158 is controlled by the controller 21 (see FIG. 1). In alternate embodiments of the invention, various alternatives or substitutions could be made to the above-described system by a person of ordinary skill in the art.

The means for spin casting molten metallic material into the mold 22 generally comprises a driver or cocking mechanism 32, a drive shaft 34, a spin arm 36, and a spring mechanism 38. The driver 32 generally comprises a drive motor 40, motor sprocket 42 connected to the shaft of the motor 40, drive chain 44, and drive wheel 46 that is rotatable supported on the drive shaft 34. The motor sprocket 42/drive chain 44/drive wheel 46 arrangement is generally provided for gear reduction purposes to make it easier for the motor 40 to turn the drive shaft 34. The drive wheel 46 comprises a stationary block 48 that rotates with the drive wheel as it is turned. Fixedly connected to the drive shaft 34 is a pneumatically actuated engagement mechanism 50 that rotates with the the drive shaft. The engagement mechanism 50 has a movable engaging block 52 that is adapted to make an interfering engaging contact with the drive wheel block 48.

Figure 8:
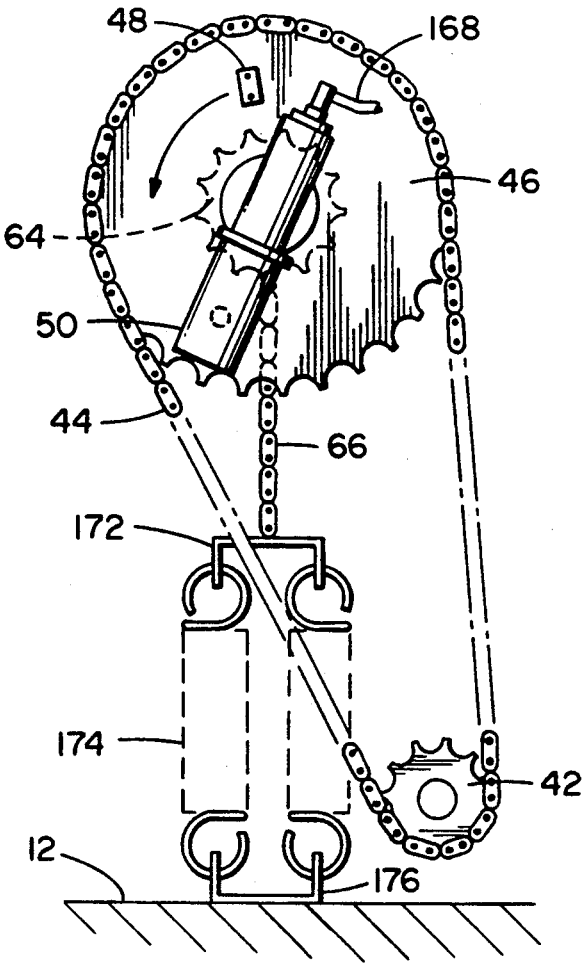
FIG. 8 is a schematic view of the driver, spring mechanism, and means for selectively engaging and disengaging the driver with the drive shaft of the furnace shown in FIG. 1.
Figure 9:
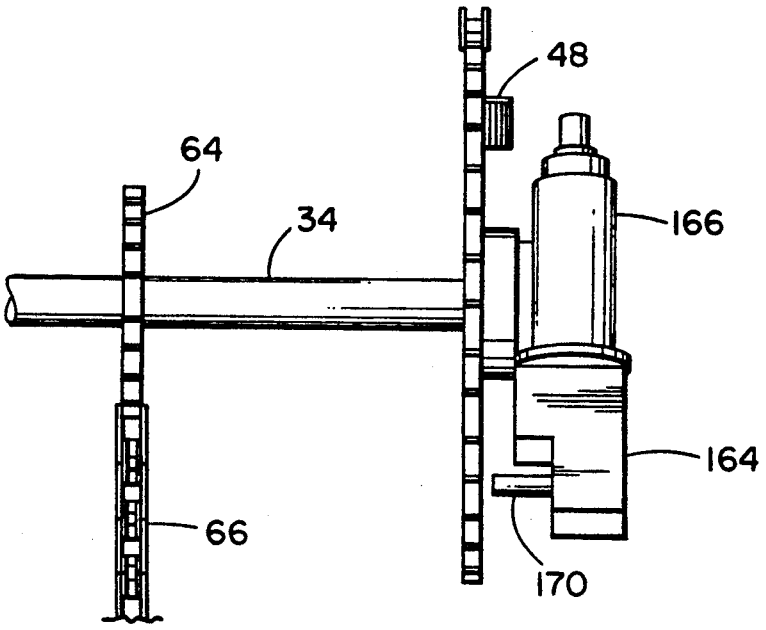
FIG. 9 is a side view of the assembly shown in FIG. 8.

Referring also to FIGS. 8 and 9, the engaging mechanism 50 has a frame 164 that is fixedly connected to the rear end of the drive shaft 34, a pneumatic cylinder 166 connected to a source of pressurized air (not shown) by conduit 168 and an internal channel in the frame 164 that the movable engaging block 62 is adapted to move in. The engaging block 52 extends into the pneumatic cylinder 166 and can be moved by pressurized air between a first position and a second position. The first position comprises the block 52 being relatively radially extended relative to the center axis of the drive shaft 34. The second position comprises the block 52 being relatively radially retracted. In the first position, an engagement portion 170 of the block 52 is positioned to be contacted by the drive wheel block 48 when the drive wheel 46 is rotated In the second position, because of the radially inward displacement of the engaging portion 170, the block 48 is unable to contact the block 52. The movement of the engaging block 52, and thus the engagement between the drive wheel 46 and drive shaft 34, is preferably controlled by the system controller 21, but may also be controlled manually. However, any suitable type of engaging/disengaging mechanism could be provided.

Also fixedly connected to a rear portion of the drive shaft 34 is a spring mechanism sprocket 64 that has spring chain 66 connected thereto. The drive shaft 34 is rotatably supported on the frame 12 by suitable front and rear bearings (not shown). The spring chain 66 is fixedly connected to the sprocket 64 at a first end and has a second end that is fixedly connected to a spring pull plate 172. In the embodiment shown, the spring mechanism 38 also comprises six coiled springs 174. However, any suitable number or type of springs can be provided. The spring mechanism 38 also comprises a base plate 176 that is fixedly connected to the frame 12. Both the spring pull plate 172 and the base plate 176 have six holes for positioning top and bottom portions of the springs 174 therein. In a preferred embodiment, the spring mechanism 38 is slightly preloaded such that the springs 174 are in slight tension with the chain 66 being held taunt between the pull plate 172 and sprocket 64. With this type of preloading, the spring mechanism 38 biases the drive shaft (because the drive shaft is fixedly connected to the sprocket) at a first radial position or orientation. Upon axial rotation of the drive shaft 34 the sprocket 64 rotates with the drive shaft 34 and pulls up on the spring chain 66. This in turn pulls up on the spring pull plate 172. The spring pull plate 172 pulls up on the top portions of the six springs 174, their bottoms being fixed to the frame 12 via base plate 176, which causes the springs to elastically deform. In the embodiment shown, the drive shaft 34 is only intended to axially rotate about 180 degrees from a home position as shown in FIG. 4 with the spring mechanism 38 being slightly preloaded, to a second cocked position wherein the springs 174 are substantially loaded or deformed and spring chain 66 is at least partially radially coiled onto the sprocket 64. In order to move the drive shaft 34 between the home position and the cocked position, the driver 32 and engagement mechanism 50 are used. Basically, the engaging block 52 is moved to its first position and the drive motor 40 is activated to drive the chain 44 and thereby cause the drive wheel 46 to rotate on the shaft 34. Eventually, the block 48 on the drive wheel 46 contacts the engaging portion 170 of the engaging block 52 of the engaging mechanism 50. The motor 40 continues to rotate the drive wheel 46 which, in turn, causes the engaging mechanism 50 to move. Due to the fixed connected of the engaging mechanism 50 with the drive shaft 34, the drive shaft is thus axially rotated. In a preferred embodiment of the invention, a rotation or location sensor (not shown) can monitor the drive shaft and signal when the drive shaft 34 has reached a cocked position, such as about 180 degrees axial rotation from its home position. However, any suitable means to signal or sense when the motor 40 should be stopped can be used. In a preferred embodiment suitable means (not shown) are provided to hold the drive wheel 46 at a set position when the motor 40 is stopped, such as the drive wheel 46 being rotatable in only a first direction.

The embodiment of the present invention shown in the drawings is specifically designed to provide a very quick axial rotation of the drive shaft from its cocked position back to its home position. The plurality of springs 174 and their offset pull on the sprocket 64 when cocked, help to provide this quick spin of the drive shaft as well as a quick release or disengagement of the drive wheel 46 from the engagement mechanism 50. From the cocked position, the pneumatic cylinder 166 and pressurized air can be used to move the engaging block 52 to its second disengaging position. In a preferred embodiment, the system control 21 controls actuation of air to pneumatic cylinder 166. With the block 52 at the second position, the engaging portion 170 no longer engages the block 48 on the drive wheel 46. Thus, with nothing impeding free rotation of the drive shaft 34 except for the pull by the spring mechanism 38, the spring mechanism 38 can pull the drive shaft 34 back into its home position.

Rotatably supported on a front end of the drive shaft 34, inside the chamber 16, is spin arm 36. The front end of the drive shaft 34 also has an engaging block 70 fixedly connected thereto. The engaging block 70 extends radially away from the center axis of the drive shaft 34 in centerlever fashion with a distal end 72 having a ramp surface 74 and an engaging notch 76.

A bearing 78 is provided between the drive shaft 34 and arm 36 to allow the arm to axially rotate on the drive shaft 34. The arm 36 is rotatably mounted to the drive shaft 34 with a first end 80 having threads and an adjustable counterweight 82 thereon, and a second end 84 having two bars 86 and 87 (see FIG. 6) for removably supporting a crucible/mold assembly 88 thereon. The counterweight 82 has internal threads that cooperate with the threads on the first end 80 such that rotation of the counterweight 82 on the first end 80 can radially move the counterweight 82 relative to the center axis of the drive shaft 34; either towards the center axis or away from the center axis. The adjustable nature of the counterweight 82 on the arm 36 is generally provided to balance the arm 36 about the center axis of the drive shaft to compensate for variances in the weight of the crucible/mold assembly 88 and amount of metallic material that is placed in the crucible prior to melting. However, any suitable counterweight mechanism can be provided. In addition, any suitable type of spin arm can also be provided.

Figure 6:
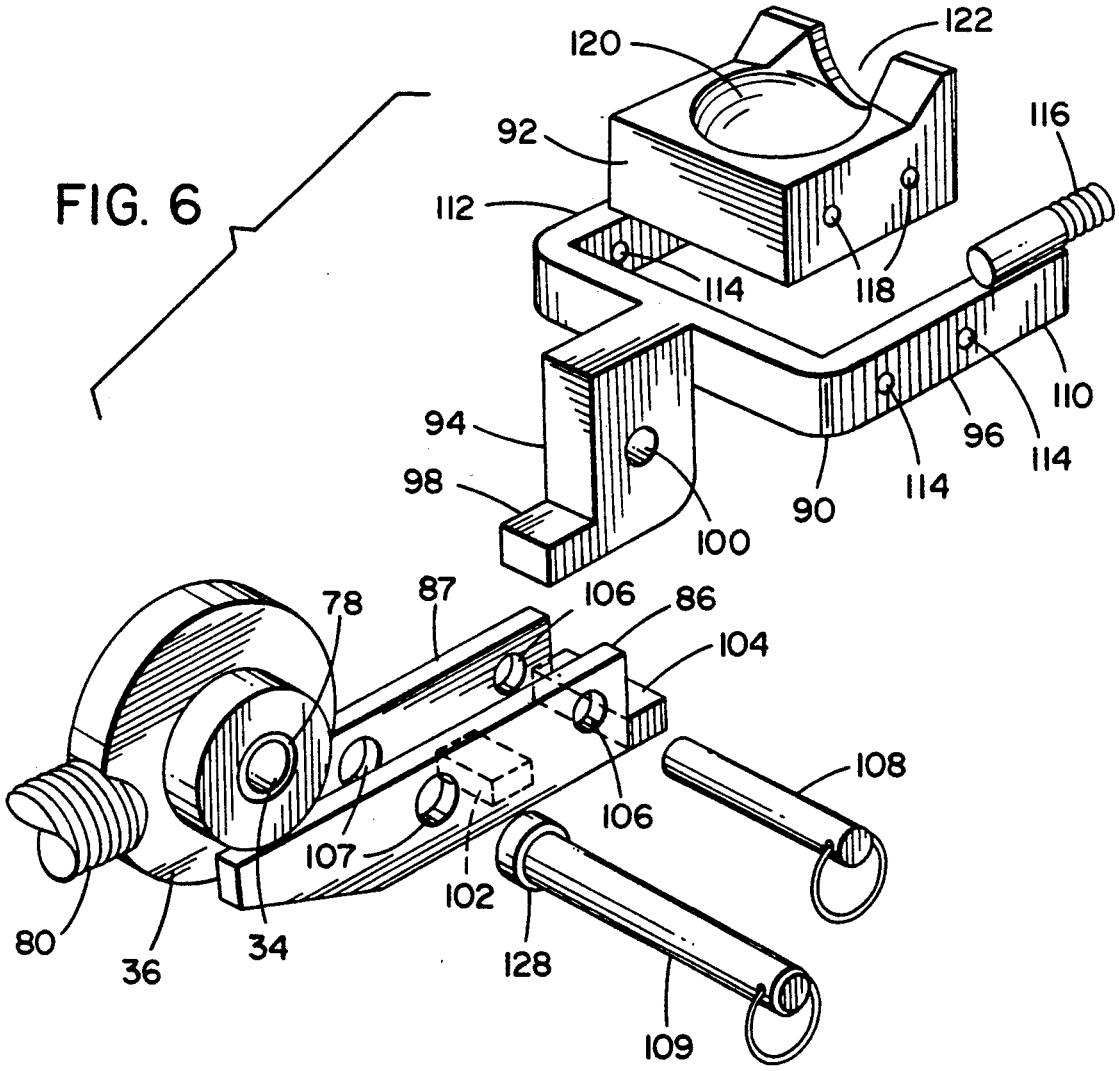
FIG. 6 is an exploded perspective view of one end of the working arm shown in FIG. 5 with its removable crucible and mold assembly.

Referring also to FIG. 6, the crucible/mold assembly 88 generally comprises a frame 90, a crucible 92, and mold 22. The frame 90 has a first portion 94 that is insertable, at least partially, between bars 86 and 87, and a second portion 96 that is generally U-shaped. The first portion 94 has a ledge 98 and a pin hole 100. The second end 84 of the arm 36 has a first beam 102 and a second beam 104 between the two bars 86 and 87 with a space therebetween. The two bars 86 and 87 also each comprise two holes 106 and 107 adapted to hold pins 108 and 109 therein. The assembly frame 90 and arm second end 84 are adapted to allow the frame first portion 94 to be positioned between the bars 86 and 87 and at least partially through the space between the beams with the top of the ledge 98 against the bottom of the first beam 102, a portion of the bottom of the assembly frame second portion 96 against the top of the second beam 104, and the first pin 108 being positioned in holes 106 and 100 to removably mount the assembly 88 to the spin arm 36. The second portion 96 of the assembly frame 90 has two side sections 110 and 112 each of which comprises holes 114 and a threaded section 116. The crucible 92 also has holes 118 that aligns with holes 114 such that fastening pins or screws can be used to mount the crucible 92 to the frame. The crucible 92 is made of a suitable material such as copper and has a center depression 120 with a molten material exit 122. As shown best in FIG. 5, the mold 22 is positioned adjacent the crucible 92 with the exit 122 aligned with a mold entrance 124. The mold 22 is retained with the frame 90 and against crucible 92 by means of a back plate 126 that has two holes for passage of the threaded sections 116 therethrough. Suitable nuts (not shown) are provided for the threaded sections 116 to retain the back plate 126 with the assembly frame 90. The second pin 109 is preferably spring biased such that distal end 128 project towards the rear of the chamber interior wall 28. The engaging notch 76 on the engaging block 70 is adapted to hold the pin distal end 128 therein and, the engaging block ramp surface 74 is adapted to push the pin distal end 128 out of the path or location of the engaging block 70 as further explained below. Although the spin arm 36 is described in the embodiment shown as spinning in a generally vertical plane, it should be understood that an alternate embodiment could include spinning in a horizontal plane or angled plane.

Figure 7:
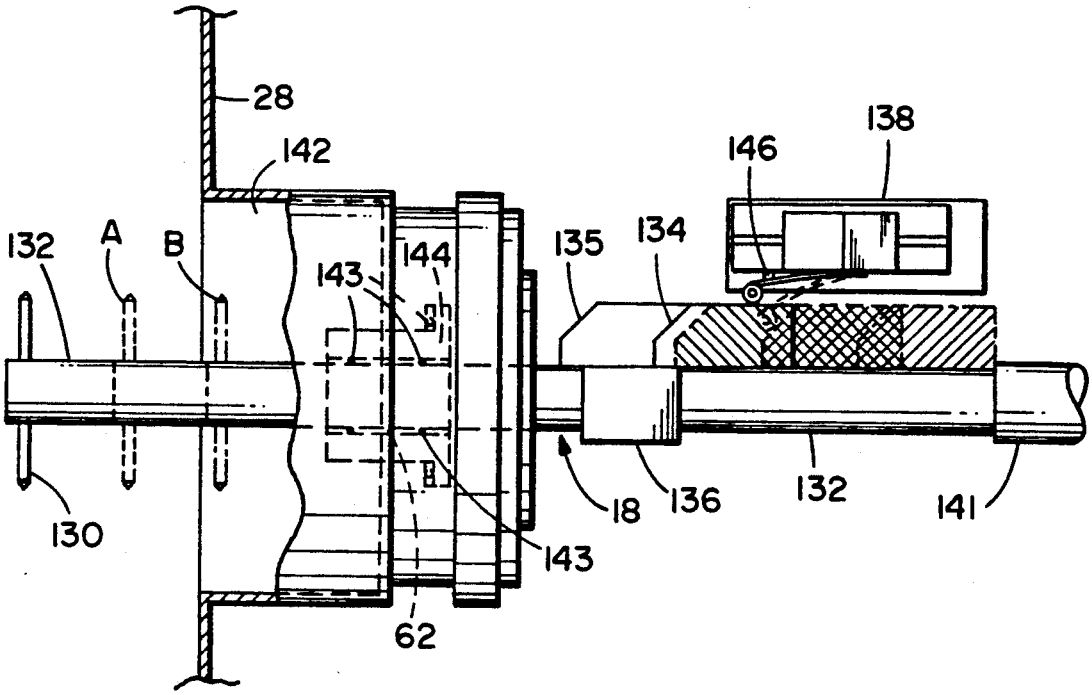
FIG. 7 is a schematic view of the electrode, control switch and portion of the chamber wall.

In order to melt metallic material in the crucible 92, the heating mechanism 18 is provided. In the embodiment shown, the heating mechanism comprises an electrode 130 that is positionable over the crucible 92 such that an arc of electricity can jump from the electrode 130 to metallic material in the crucible and thereby heat the metallic material into a molten state. Referring also to FIG. 7, the heating mechanism also comprises a positioning arm 132, control switch ramps 134 and 135 on a block 136 attached to the positioning arm 132, a heating control switch block 138 mounted to a stationary bar 140 of the frame 12(see FIG. 4), and a pneumatic cylinder 141 fixedly connected to the frame 12 with the rear end of the positioning arm 132 projecting thereinto and suitable pneumatic supply lines. A seal and bearing assembly 144 is also provided and the heating control switch block 138 has two switches that are triggered by the up or down position of two levers 146 and 147 which interact with the block 136 to be moved up and down.

The positioning arm 132 is movably positioned in the fifth aperture 62 of the chamber interior wall 28 with suitable seals 143, such as O-rings, and teflon bearing 144 for longitudinal axial movement therein. However, any suitable seals and bearings could be provided. The positioning arm 132 generally has three positions, a first position wherein the electrode 130 is positioned over the crucible 92, a second partially retracted position as shown at position A in FIG. 7, and a third fully retracted position as shown at position B in FIG. 7. The interior chamber wall 28 has a recess 142 to accommodate the electrode 130 when the positioning arm 132 is fully retracted. The electrode 130 is fixedly connected to the front end of the positioning arm 132 and is electrically connected to a power source via system control 21 which can selectively energize and deenergize the electrode 130. The rear end of the positioning arm 132 is positioned in the pneumatic cylinder 141 which is adapted to longitudinally move the positioning arm 132 between extended and retracted positions. Pneumatics are used to move the positioning arm 132 and electrode 130 such that they can be moved relatively fast. However, any suitable type of means could be used to position the electrode 130 over the crucible and the electrode may also be fixed to the spin arm 36 or crucible/mold assembly 88 in alternate embodiments of the invention. With the ability of moving the electrode 130 by means of the pneumatic cylinder 141, the electrode 130 can be moved away from the path of the spin arm 36 to allow the spin arm 36 to rotate without interference from the heating mechanism 18. In the embodiment shown, the electrode 130 is vertically adjustable or positionable on the positioning arm to adjust the distance between the electrode 130 and the metallic material.

In the first extended position, the two levers 146 and 147 are located in an up position by block 136. The second lever 147, when in its up position, signals the system control 21 (see FIG. 1) that the electrode 130 and forward portion of the positioning arm 132 are not fully retracted. The first lever 146, when in its up position, signals the system control 21 that the electrode is located over the crucible 92. When the positioning arm 132 is being retracted and is moved to the second partially retracted position A, the first lever 146 slides down the first ramp 134. Due to the longitudinally offset nature of the two ramps 134 and 135, the second lever 147 remains up. In this position the two switches signal the system control 21 that the electrode 130 should be turned off (because it is no longer over the crucible), but that the spin arm 36 should not be allowed to spin because the electrode 130 and forward portion of the positioning arm 132 have not moved fully out of the path of the spin arm 36. Upon the positioning arm 132 reaching the fully retracted position B, the second lever 147 slides down the second ramp 135. In this position the two switches signal the system control 21 that the electrode 130 should remain off and the spin arm 36 can spin without risk of hitting the heating mechanism 18. In a similar fashion, when the electrode is extended or is being extended from its retracted position, the spin arm 36 would not be allowed to spin and the electrode would not be allowed to be energized until it is over the crucible 92.

One means to prevent the spin arm 36 from rotating, except when intended, in the preferred embodiment shown, includes the use of safety bar mechanism 150. The safety bar mechanism 150 generally comprises a safety bar 152 and a pneumatic cylinder 154 connected to a supply by tubes 156 and 157. A forward portion of the safety bar 152 projects through the interior chamber wall 28 at second aperture 56 and is longitudinally movable therein with a suitable seal and bearing (not shown) therebetween. The pneumatic cylinder 154 is fixedly connected to the frame 12 and the safety bar 162 projects therethrough and can be longitudinally moved by introduction of pressurized air into the cylinder 154 at tubes 156 and 157 to move the bar 152 between a first safety position with the bar 152 projecting into the path of the spin arm 36 and, a second position with the bar 152 being retracted out of the path of the spin arm 36. In the event the spin arm attempts to spin in the chamber 16 while the safety bar 152 is extended in its first safety position, the arm 36 will contact the safety bar and thereby be prevented from further rotation. In a preferred embodiment, the supply of pressurized air to pneumatic cylinder 150 is controlled by the system control 21. However, any suitable type of safety system or control can be provided.

Figure 10:
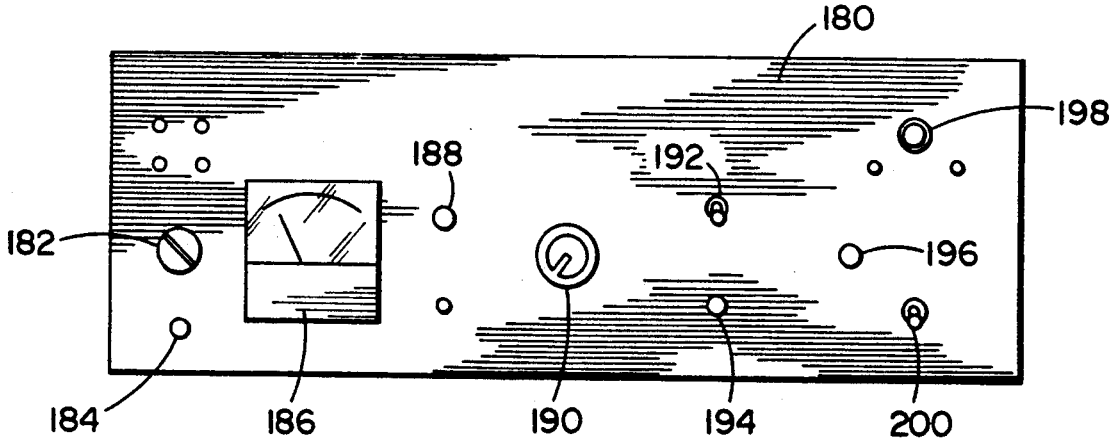
FIG. 10 is a plan front view of the control panel of the furnace shown in FIG. 1.

In order to control the various features and timing or allowability of various operations or actions of the furnace 10, the system controller 21 is provided. The system controller, in the embodiment shown, is an electronic system, having various buttons or switches and other features such as a computer or microprocessor, that controls the positioning of various valves, operation of the various pneumatic cylinders, drive motor 40, evacuation pump 20, energizing of the electrode 130, as well as other features including accessory features as will be described below. In the embodiment shown, the furnace 10 comprises a control panel 180 that allows the operator to at least partially control the operation of the system. A plan front view of the control panel 180, for the embodiment shown, can be seen in FIG. 10. However, it should be understood that any suitable type of control and control panel could be provided.

Figure 12:
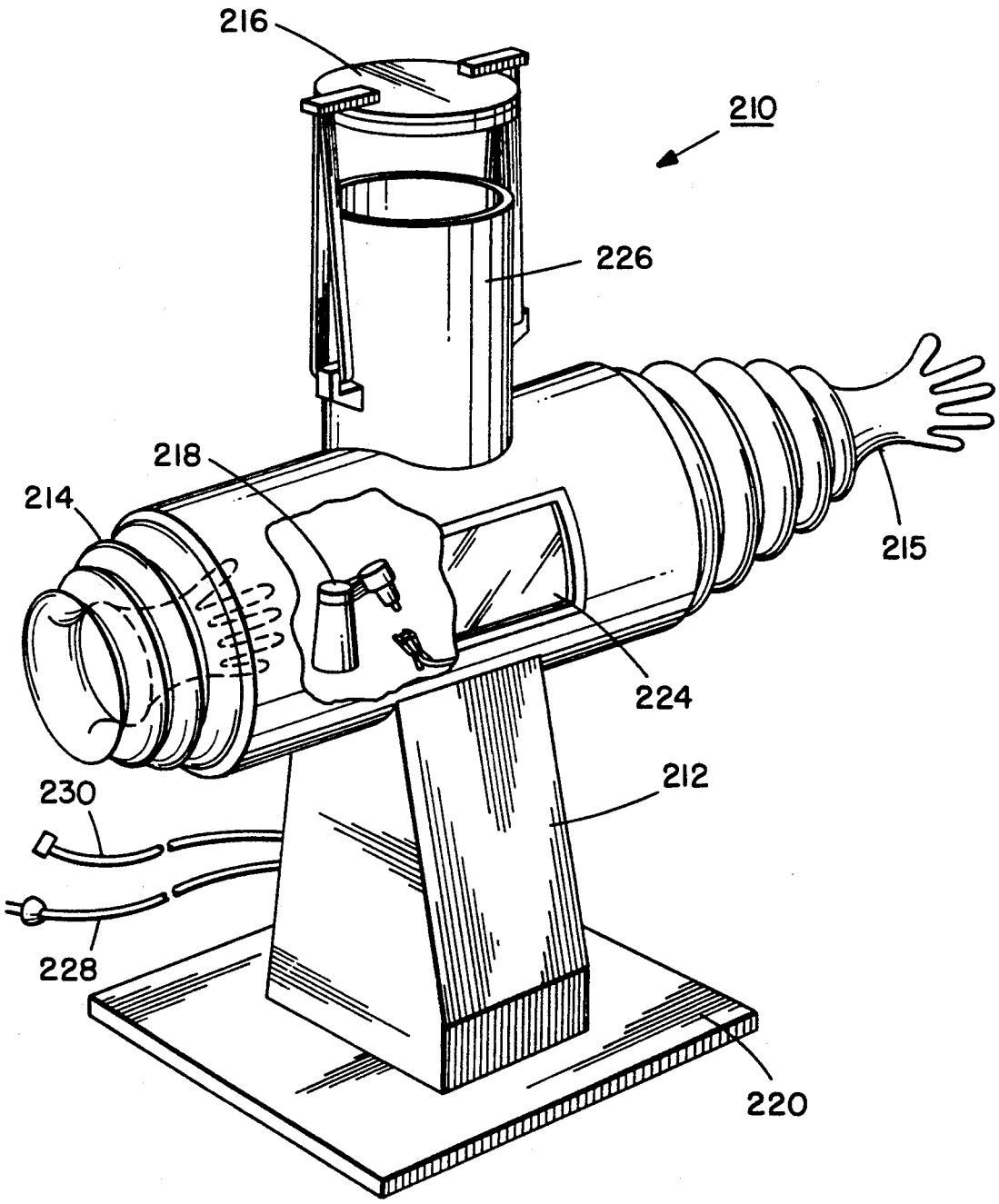
FIG. 12 is a perspective isometric view of a glove box unit.

In the embodiment shown, the control panel 180 comprises an evacuation/cocking dial 182, a vent button 184, an electric current gage 186, a gas button 188, an electric amperage control dial 190, an electric system selector toggle switch 192, an arc button 194, a cast button 196, a glove box electric current control dial 198, and a glove box gas flow toggle switch 200. The glove box 210 shown in FIG. 12 is disconnectable from the furnace 10, but is controlled, at least partially, by the system controller 21 and control panel 180 as will further be described below. The evacuation/cocking dial 182 can be moved to an evacuation setting wherein the system control 21 energizes the evacuation pump 20 to evacuate air and/or other gases from the chamber 16. The dial 182 also can be moved to a cock setting wherein the system control 21 energizes the drive motor 21 and sets the engaging block 52 of the engaging mechanism 50 to its first engaging position. The operation of the evacuation pump 20 can be stopped by the operator moving the dial 182 away form its evacuation setting or by an automatic pressure sensor (not shown). The cocking of the drive shaft 34 can be stopped by the operator moving the dial 182 away form its cock setting or by an automatic position sensor (not shown) that can sense when the drive shift 34 has reached a predetermined axial rotation position and stop the drive motor 40, but keep the drive shaft 34 at its cocked position.

The vent button 184 operably controls, via the system controller 21, the positioning of the valve 158 (see FIG. 4) to its vent position wherein air can be allowed to enter the chamber 16 through the valve 158. Alternatively, the evacuation pump 20 can be reversed to push air into the chamber 16. The gage 186 is adapted to shown the amount of the electric current flowing to the electrode 130 and/or the glove box electrode 218. The gas button 188 at least partially controls the valve 158 to allow inert gas from a gas supply (not shown) to flow into the chamber 16. The amperage control dial 190 is variable between a low position and a high position to allow an operator to control the amperage of current flowing to the electrode 130 and/or the glove box electrode 218. However, in an alternate embodiment an automatic amperage control might be provided. The system selector toggle switch 192, in the embodiment shown, basically has three positions; a first position that allows the supply of electricity to both the main unit electrode 130 and glove box electrode 218, a second position that allows the supply of electricity to only the main unit electrode 130, and a third position that allows the supply of electricity to only the glove box electrode 218. The arc button 194 is used by an operator to actuate the supply of electricity to the main unit electrode 130 and/or the glove box electrode 218. The glove box electric current or amperage control dial 198 is variable between a low position and a high position to allow an operator to control the flow of current to the glove box electrode 218 separate from the control of the main unit electrode current control. The glove box gas flow toggle switch 200 is a two position switch that controls a gas valve (not shown) connected to an inert gas supply (not shown). The valve (not shown) can be connected to the glove box 210 by a suitable conduit 230 such that, by use of the switch 200, an operator can selectively allow inert gas to flow to the glove box.

The operation of the main unit furnace 10 will now be described. After the mold 22 is made, it is assembled with the crucible 92 and assembly frame 90 to form the crucible/mold assembly 88. An operator can than connect the assembly 88 with the spin arm 36 and fix the assembly to the spin arm with positioning of pin 108. The operator can then place metallic material, such as titanium, in the crucible 92, if not already done so. The operator pushes the pin 109 to an engaging position wherein it can be caught in the engaging notch 76 of the engaging block 70. The operator also adjusts the counter weight 82 to balance the spin arm 36 about the drive shaft center axis. During this loading procedure, the door 14 is obviously open and the safety bar 152 can be extended. In a preferred embodiment, suitable means are provided to prevent the door 14 from being opened without the safety bar 152 being extended. The operator then turns the evacuation/cocking dial 182 to its cock setting. If not already extended, the safety bar 152 will automatically extend. The operator can then manually pull the electrode 130 and positioning arm 132 out from its retracted position and can manually adjust the electrode 130 on the positioning arm 132 to adjust the distance between the electrode 130 and the crucible 92 and metallic material therein. With this loading and set up completed, the operator can then close and lock the door 14 and turn the evacuation/cocking dial 182 to its evacuation position. A pressure gage 202 on the door 14 can indicate the vacuum pressure in the chamber 16. The operator can manually stop the evacuation pump 20 by turning the dial 182 away from its evacuation position after reaching a predetermined or selected vacuum pressure or alternatively, suitable means could be provided to do this automatically. Once the first vacuum step is completed, the operator can press the gas button 188 such that valve 158 is opened to allow inert gas, such as helium, to flow into the chamber 16.

The preferred method of the invention comprises the use of multiple purges; each purge comprising an evacuation of the chamber 16 and introduction of inert gas into the chamber 16 after evacuation. The reason for this preferred method is to reduce, if not eliminate, all reactive gases and elements from inside the chamber 16 prior to melting of the metallic material. The problem which the preferred method seeks to remedy is that, even with an initial evacuation of air from the chamber 16 by evacuation pump 20, some residual air remains in the chamber 16. The residual air, although relatively small, can nonetheless adversely contaminate the metallic material when being melted. Thus, after a first initial purge (initial evacuation and initial filling of the chamber with inert gas) at least one addition purge is performed. During the second and possible subsequent purges, the residual air becomes mixed with the inert gas in the chamber 16. The number of purges can either be controlled by the operator or the system control 21 can be preprogrammed to perform a predetermined number of purges automatically, such as ten. However, any suitable number of purges can be performed. In addition, because of the location of the third aperture 58 being located above the fourth aperture 60, in the embodiment shown, and that the inert gas is lighter than air, this also helps to evacuate the air from the chamber 16 by forcing the air down toward the fourth aperture 60. As noted above, any suitable type of inert gas can be used, such as argon or helium. In addition, the multipurge process need not be provided.

Once the purge process is complete, the operator can press the arc button 194. In a preferred method, the amperage control dial 190 is set on a low setting when the arc button 194 is depressed. Once the arc button 194 is depressed, the system control 21 automatically retracts the safety bar 152. The operator can look through the view port 26 to see when the electric arc from the electrode 130 to the metallic material is established and can then rotate the amperage control dial 190 to a high position to bring the electric arc up to full power. The operator can observe the melting of the metallic material in the crucible through the view port 26 and, when sufficiently molten, can then press the cast button 196.

After the cast button 196 is depressed, the system control 21 actuates the heating mechanism pneumatic cylinder 141 which causes the positioning arm 132 to move back from its extended position to its retracted position. The electrode 130 and arc remain on to keep the metallic material in the crucible 92 molten until the block 136 and electrode 130 reach position A (see FIG. 7). At position A, the first lever 146 has slid down the first ramp 134 and uses its switch to signal the system control 21 that the electrode 130 is no longer over the crucible 92. In a preferred embodiment, this is about ½ inch to about ¾ inch past the edge of the crucible 92. The system control 21 thus terminates power to the electrode 130 and causes the heating arc to cease. The positioning arm 132 and electrode 130 continue to retract until position B is reached at which point the second lever 147 has slid down the second ramp 135 causing its switch to signal the system control 21 that the heating mechanism is fully retracted. The system control 21 can then deactivate the pneumatic cylinder 141.

With the occurrence of full retraction of the heating mechanism, the system control 21 causes the engaging mechanism 50 to move out of engagement with the block 48 on the drive wheel 46 by means of the pneumatic cylinder 166. With nothing preventing the drive shaft 34 from axially rotating and the spring mechanism 38 pulling on the drive shaft 34 with a relatively large amount of force, the drive shaft 34 is axially rotated from its cocked position back to its home position, about 180 degrees, at a very fast speed. Because the forward engaging block 70 is fixedly connected to the drive shaft 34, it turns with the drive shaft 34. Although the spin arm 36 is rotatably mounted on the drive shaft 34, because the forward engaging block 70 has a portion of pin 109 in engaging notch 76, the axial rotation of the drive shaft 34 is imparted to the spin arm 36 via the forward engaging block 70 and pin 109. Thus, the spin arm 36 is rotated with the drive shaft 34, at least until the drive shaft reaches its home position.

The centrifugal force imparted on the molten metallic material in the crucible 92 causes the material to flow through the exit 122, into the mold entrance 124, and fill the shaped cavity in the mold 22. In a preferred method, the rotational speed of the spin arm 36 is sufficiently great to cause the molten material to fill the mold 22 within about one-half a rotation. However, greater or less speed can be provided to allow the mold to be filled quicker or slower. The material in the mold cools and solidifies relatively quick.

Because the engaging notch 76 is open on one side, and although the drive shaft 34 and forward engaging block 70 stop after about a 180 degree rotation, the spin arm 36 can continue to rotate; rotating relative to the drive shaft 34. The spin arm 36 is thus allowed to spin about the drive shaft 34 until it stops. To prevent the pin 109 from hitting the forward engaging block 70 and causing an abrupt stop that could otherwise damage the furnace 10, assembly 88, or cast in the mold 22, as the spin arm 36 rotates, the rear end of the pin 109 contacts the ramp surface 74 on the forward engaging block 70 to push the pin 109 out of the location of the block 70. When the spin arm 36 stops spinning, the operator can press the vent button 184, open the door 14, pull pin 108 out, and remove the assembly 88. A new assembly can be immediately set in location on arm 36 and the process repeated for another cast. It should be understood that the above description is only illustrative of the invention and that various modifications or alterations could be made.

The furnace 10 also provides for deactivating the unit after the drive shaft 34 and spring mechanism 38 have been cocked, before melting the metallic material, through the use of a dummy spin. A dummy spin would be appropriate where the drive shaft had been cocked, but the complete casting process would not be completed for a relatively long time, such as at the end of a work day where the cast process would not be completed until the next day. In this event, the operator would remove the solid metallic material from the crucible, push the electrode 130 back to its recessed position, balance the spin arm 36, and close the door 14. The operator could then turn the evacuating/cocking dial 182 to its cock setting and simultaneously push the arc button 194 for a predetermined period of time, such as 15 seconds.

The system control 21 would then retract the safety bar 152 and actuate the engaging mechanism 50 to release the cocked drive shaft 34 and allow the spin arm 36 to spin. This dummy spin would be appropriate to return the springs 174 to their home position and prevent permanent deformation.

The furnace 10 also comprises a safety interlock system connected with the system control 21. In the event the door 14 is open, the safety interlock system, although allowing cocking of the drive shaft 34, prevents the electric arc from starting, prevents operation of the pump 20, and prevents rotation of the spin arm 36. In the event the door 14 is closed, the drive shaft 34 is prevented from being cocked; i.e.: the drive shaft must be cocked before the door is closed. However, with the door closed, the electric arc is able to start, the pump 20 is able to operate, and the spin arm is able to spin. It should be understood that alternate embodiments can also be provided.

Figure 11:
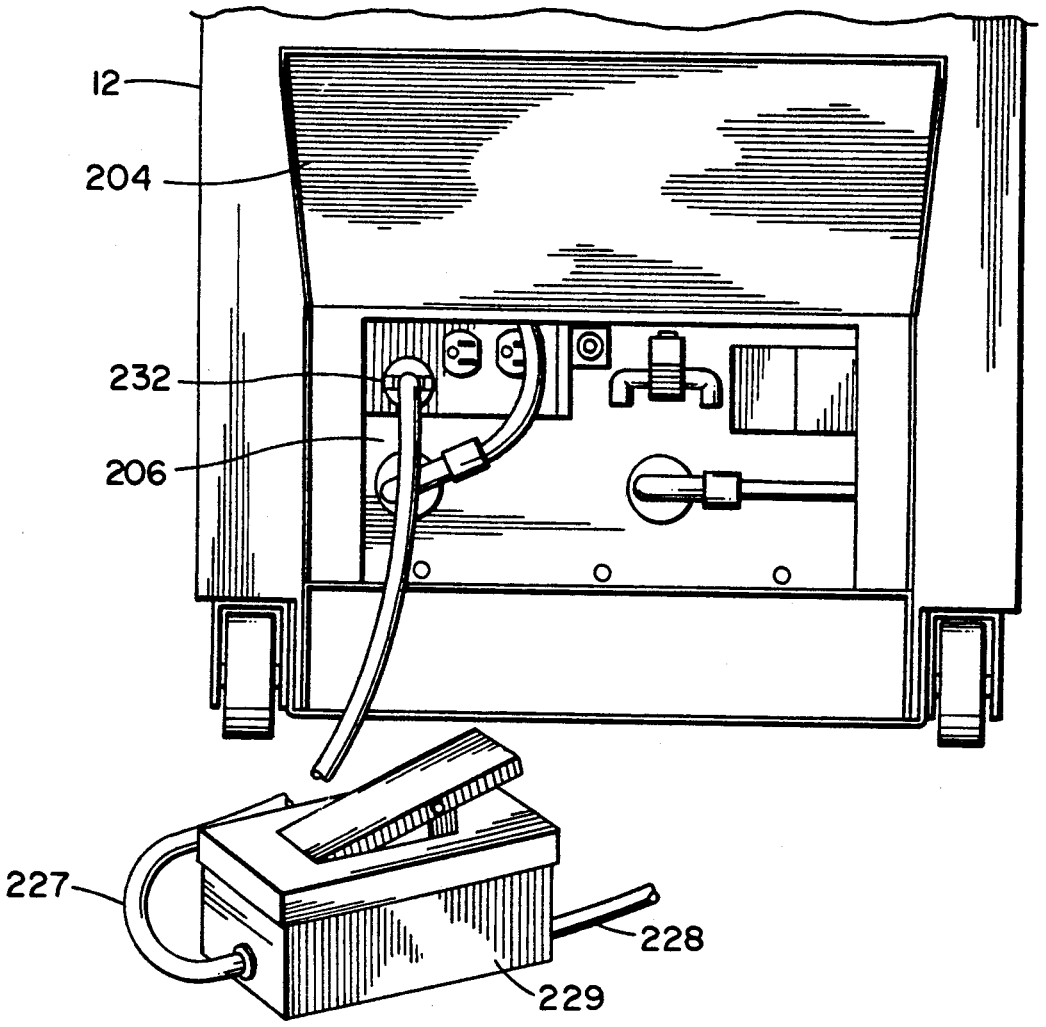
FIG. 11 is a perspective front view of the front utility panel of the furnace shown in FIG. 1.

Referring now also to FIGS. 11 and 12, the main unit 10, in the embodiment shown, has a cover 204 over a front utility panel 206 with means for operably connecting a glove box unit 210 therewith. The glove box unit 210 is intended to be operably connected to the main unit 10 and generally comprises a frame 212, glove portions 214 and 215, exit valve 216 and electrode 218. The frame 212 has a pedestal 220, for locating the unit 210 on a table top or the like, a chamber tube 222 with a view port 224, and a stove pipe section 226 extending up from the chamber tube 222. An electrical supply conduit 228 and a gas supply conduit 230 extend into the chamber tube 222. The electrode has suitable means for connecting the conduits 228 and 230 thereto. The glove portions 214 and 215 are connected and sealed with the ends of the chamber tube 222. An operator can insert a casting that needs to be reworked into the glove box unit 210 through the stove pipe section 226 and then close over the aperture with valve 216.

Similar to the casting process, any reworking should be done in an inert gas atmosphere. Thus, inert gas, either from the main unit 10 or from an independent source (not shown) can be pumped into the glove box unit. This causes pressure to build in the glove box unit, which causes the flexible glove portions to expand outward. The operator, by putting his hands into the glove portions and pressing inward can help displace air through the valve 216. This type of manual purge can be repeated several times to remove air from the glove box unit. The operator can then use the electrode 218 to cut, weld, braze, etc. the casting as desired. However, it should be understood that the glove box unit need not be provided. In addition, any suitable type of accessory unit could be provided.

One of the advantageous features of the present invention is that the glove box unit, or any other accessory, can be at least partially supplied and controlled by the main unit 10. This supply and control can include vacuum, electrical and inert gas. In the prior art, any type of glove box unit had its own power and inert gas supply and control. With the present invention, because the main unit supply and control is also used for the glove box unit, the glove box unit can be provided without its own supply and control, thus reducing the cost of the glove box unit. In the embodiment shown, the glove box unit is removably connected to the main unit for both electrical supply and inert gas supply. However, inert gas supply, vacuum supply, and electrical supply could be provided separately to the glove box unit. The control panel 206 has an electrical outlet 232 that is connected to the glove box unit 210 by electrical conduit 227, foot pedal control box 229, and electrical conduit 228. The foot pedal control box 229 is provided such that the operator of the glove box unit does not need to take his hands out of the glove box unit to alter current to the electrode 218.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An apparatus for casting metallic material having a frame with a chamber, a heating source, and means for spin casting the metallic material comprising a rotatable arm connected to a drive shaft and a mold on said arm, said means for spin casting further comprising:

a driver for axially rotating said drive shaft;

means for selectively engaging and disengaging said driver with said drive shaft;

means for biasing said drive shaft at a first position; and means for preventing axial rotation of said drive shaft past a predetermined angular rotation.

2. An apparatus as in claim 1 wherein said driver comprises a motor connected to a drive wheel adapted to axially rotate said drive shaft.

3. An apparatus as in claim 1 wherein said means for selectively engaging and disengaging said driver with said drive shaft comprises a selectively movable interlocking mechanism to selectively engage and disengage said driver with said drive shaft.

4. An apparatus as in claim 3 wherein said interlocking mechanism comprises a hydraulic machinery fixedly connected to said drive shaft having a movable portion engageable with a portion of a drive wheel of said driver.

5. An apparatus as in claim 1 wherein said means for biasing said drive shaft at a first position comprises springs radially connected to said drive shaft.

6. An apparatus as in claim 5 wherein said springs are connected to said drive shaft by an elongate member that can be coiled onto a portion of said drive shaft as said drive shaft is axially rotated to pull on said springs.

7. An apparatus as in claim 6 wherein said elongate member is comprised of a chain and said drive shaft portion comprises a sprocket fixed to said drive shaft.

8. An apparatus as in claim 6 wherein said springs have first ends connected to said frame and second ends connected to a spring pull plate which is connected to said elongate member.

9. An apparatus as in claim 1 wherein said means for preventing axial rotation of said drive shaft past a predetermined angular rotation comprises said means for biasing said drive shaft at a first position.

10. An apparatus as in claim 1 wherein said means for preventing axial rotation is adapted to limit axial rotation of said drive shaft to about 180 degrees.

11. An apparatus as in claim 1 wherein said arm is rotatably mounted on said drive shaft.

12. An apparatus as in claim 11 further comprising means for selectively moving said arm with said drive shaft.

13. A system for casting and reworking metallic material comprising:

a glove box unit with an electrode;

a main unit having a chamber, a heating source, means for spin casting molten metallic material into a mold, and a system control; and means for connecting said glove box unit with said main unit.

14. A system as in claim 13 wherein said means for connecting is adapted to disconnectably connect said glove box unit with said main unit.

15. A system as in claim 13 wherein said main unit comprises sources of vacuum and inert gas and said means for connecting comprises means for conduiting inert gas to and from said main unit to said glove box unit.

16. A system as in claim 13 wherein said means for connecting comprises means for transmitting electrical current from said main unit to said glove box unit.

17. An apparatus for casting metallic material having a frame with a chamber, a heat source, and means for spin casting the metallic material comprising an arm connected to a drive shaft and a mold connected to said arm, said means for spin casting further comprising:

a driver for axially rotating said drive shaft;

means for selectively engaging and disengaging said driver with said drive shaft; and means for biasing said drive shaft at a first position.

18. An apparatus as in claim 17 wherein said means for selectively engaging and disengaging said driver with said drive shaft comprising a selectively movable interlocking mechanism fixedly connected to said drive shaft and, said driver comprising a motor connected to a drive wheel, said interlocking mechanism being selectiovely engageable and disengagable with a portion of said drive wheel.

* * * * *